US010961800B2

(12) United States Patent
Guidry

(10) Patent No.: US 10,961,800 B2
(45) Date of Patent: Mar. 30, 2021

(54) FRAC STACKS WITH RAMS TO CLOSE BORES AND CONTROL FLOW OF FRACTURING FLUID

(71) Applicant: Cameron International Corporation, Houston, TX (US)

(72) Inventor: Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/837,176

(22) Filed: Dec. 11, 2017

(65) Prior Publication Data

US 2018/0163501 A1 Jun. 14, 2018

Related U.S. Application Data

(60) Provisional application No. 62/433,923, filed on Dec. 14, 2016.

(51) Int. Cl.

| | |
|---|---|
| ***E21B 33/06*** | (2006.01) |
| ***E21B 43/26*** | (2006.01) |
| ***E21B 34/02*** | (2006.01) |
| ***E21B 33/068*** | (2006.01) |

(52) U.S. Cl.

CPC ..... *E21B 33/062* (2013.01); *E21B 33/063* (2013.01); *E21B 33/068* (2013.01); *E21B 34/02* (2013.01); *E21B 43/26* (2013.01)

(58) Field of Classification Search

None

See application file for complete search history.

(56) References Cited

U.S. PATENT DOCUMENTS

| | | | | |
|---|---|---|---|---|
| 2,224,446 | A | | 12/1940 | Penick et al. |
| 2,238,357 | A | | 4/1941 | Allen |
| 2,427,073 | A | | 9/1947 | Schweitzer |
| 2,923,310 | A | | 2/1960 | Eckert |
| 3,102,709 | A | | 9/1963 | Allen |
| 3,159,378 | A | | 12/1964 | Haag |
| 3,333,816 | A | | 8/1967 | Williams et al. |
| 4,089,532 | A | | 5/1978 | Kamyshnikov et al. |
| 4,214,605 | A | * | 7/1980 | Hardgrave ..... E21B 33/062 137/495 |
| 4,541,608 | A | | 9/1985 | Forester et al. |
| 5,005,802 | A | | 4/1991 | McWhorter et al. |
| 5,013,005 | A | | 5/1991 | Nance |
| 5,819,851 | A | * | 10/1998 | Dallas ..... E21B 17/1007 166/308.1 |
| 6,164,619 | A | | 12/2000 | Van Winkle et al. |
| 6,244,336 | B1 | | 6/2001 | Kachich |
| 6,289,993 | B1 | | 9/2001 | Dallas |
| 6,296,225 | B1 | | 10/2001 | Watts |

(Continued)

OTHER PUBLICATIONS

Cameron General Catalog 1962-1963, Cameron Iron Works, Inc., Houston, Texas, cover and p. 1112 (2 pages).

*Primary Examiner* — Daphne M Barry
(74) *Attorney, Agent, or Firm* — Eubanks PLLC

(57) ABSTRACT

A fracturing system having rams for controlling flow through a fracturing tree is provided. In one embodiment, a fracturing system includes a frac stack mounted on a wellhead. The frac stack includes opposing rams to control flow of fracturing fluid through a bore of the frac stack during a fracturing operation. Additional systems, devices, and methods for fracturing are also disclosed.

26 Claims, 10 Drawing Sheets

(56) References Cited

U.S. PATENT DOCUMENTS

| | | | | |
|---|---|---|---|---|
| 6,719,262 | B2 | 4/2004 | Whitby et al. | |
| 7,207,382 | B2 * | 4/2007 | Schaeper | E21B 33/063 166/55 |
| 8,573,557 | B2 | 11/2013 | Carbaugh et al. | |
| 9,249,643 | B2 | 2/2016 | Melancon | |
| 9,777,546 | B2 | 10/2017 | Hoover et al. | |
| 10,233,716 | B2 | 3/2019 | van Wijk et al. | |
| 2006/0113501 | A1 | 6/2006 | Isaacks et al. | |
| 2006/0254822 | A1 * | 11/2006 | Ayling | E21B 19/16 175/57 |
| 2011/0030963 | A1 * | 2/2011 | Demong | E21B 43/26 166/313 |
| 2013/0153237 | A1 | 6/2013 | McGuire | |
| 2015/0000901 | A1 * | 1/2015 | Guidry | E21B 33/068 166/250.01 |

* cited by examiner

FRAC STACKS WITH RAMS TO CLOSE BORES AND CONTROL FLOW OF FRACTURING FLUID

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Additionally, such wellhead assemblies may use a fracturing tree and other components to facilitate a fracturing process and enhance production from a well. As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. This facilitates, for example, coupling of pre-existing fissures and cavities, allowing oil, gas, or the like to flow into the wellbore. Such fracturing processes typically include injecting a fracturing fluid—which is often a mixture including sand and water—into the well to increase the well's pressure and form the man-made fractures. During fracturing operations, fracturing fluid may be routed via fracturing lines (e.g., pipes) to fracturing trees installed at wellheads. Conventional fracturing trees have valves that can be opened and closed to control flow of fluid through the fracturing trees into the wells.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

At least some embodiments of the present disclosure generally relate to fracturing systems using rams to control fluid flow through a fracturing tree during fracturing operations. In some embodiments, the fracturing tree includes a frac stack body having ram cavities provided along a bore. Rams in the ram cavities can be opened and closed to control fracturing fluid and pressure in the fracturing tree. The fracturing tree and its components can include various features to reduce erosive wear of seals of the rams from fracturing fluid flowing through the tree. For example, in certain embodiments, a protective sleeve can be included to cover the ram cavities during fracturing.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
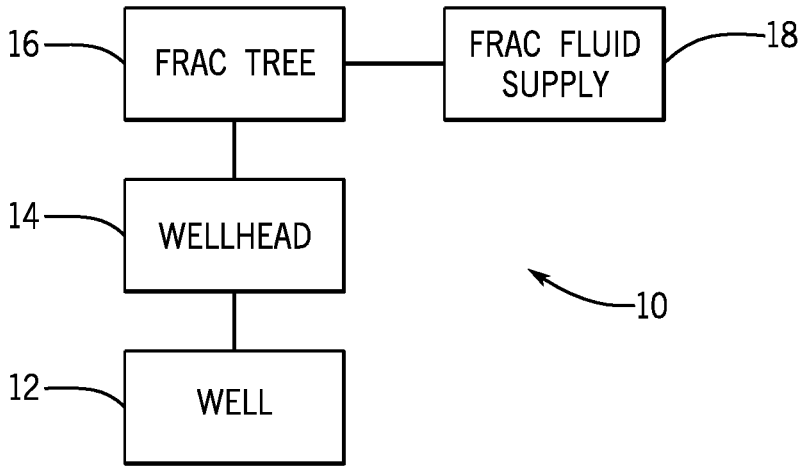
FIG. 1 generally depicts a fracturing system having a fracturing tree in accordance with an embodiment of the present disclosure.
Figure 2:
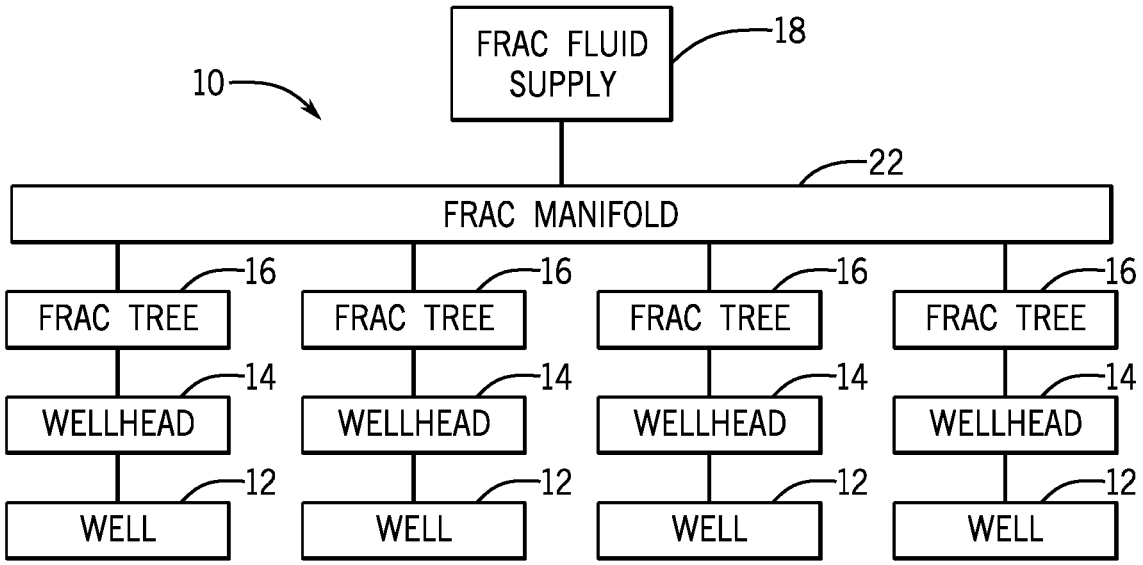
FIG. 2 is a block diagram of the fracturing system of FIG. 1 with a fracturing manifold coupled to multiple fracturing trees in accordance with one embodiment.

Turning now to the present figures, examples of a fracturing system 10 are provided in FIGS. 1 and 2 in accordance with certain embodiments. The fracturing system 10 facilitates extraction of natural resources, such as oil or natural gas, from a subterranean formation via one or more wells 12 and wellheads 14. Particularly, by injecting a fracturing fluid into a well 12, the fracturing system 10 increases the number or size of fractures in a rock formation or strata to enhance recovery of natural resources present in the formation. Wells 12 are surface wells in some embodiments, but it will be appreciated that resources may be extracted from other wells 12, such as platform or subsea wells.

The fracturing system 10 includes various components to control flow of a fracturing fluid into the well 12. For instance, the fracturing system 10 depicted in FIG. 1 includes a fracturing tree 16 that receives fracturing fluid from a fluid supply 18. In some embodiments, the fracturing fluid supply 18 is provided by trucks that pump the fluid to fracturing trees 16, but any suitable sources of fracturing fluid and manners for transmitting such fluid to the fracturing trees 16 may be used. Moreover, the fluid supply 18 may be connected to a fracturing tree 16 directly or via a fracturing manifold 22, as generally depicted in FIG. 2. The fracturing manifold 22 can include conduits, such as pipes, as well as valves or sealing rams to control flow of fracturing fluid to the fracturing trees 16 (or from the fracturing trees 16, such as during a flowback operation). As depicted in FIG. 2, the fracturing manifold 22 is connected to provide fracturing fluid to multiple fracturing trees 16, which may then be routed into respective wells 12 via wellheads 14. But it is noted that the fracturing manifold 22 may instead be coupled to a single fracturing tree 16.

Figure 3:
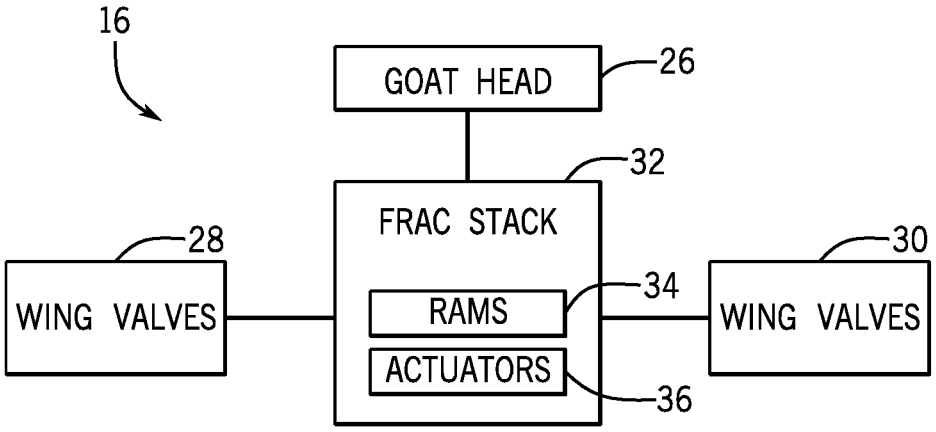
FIG. 3 is a block diagram showing components of the fracturing tree of FIG. 1, including a frac stack having rams for controlling flow through the fracturing tree, in accordance with one embodiment.

Fracturing trees have traditionally included valves (e.g., gate valves) that control flow of fracturing fluid to and from wells through the trees. In at least some embodiments of the present disclosure, however, the fracturing trees 16 use sealing rams instead of valves to control flow through the trees. One example of such a fracturing tree 16 is depicted in FIG. 3 as including a goat head 26, wing valves 28 and 30, and a fracturing stack ("frac stack") 32. The goat head 26 includes one or more connections for coupling the fracturing tree 16 in fluid communication with fluid supply 18, such as via fracturing manifold 22. This allows fracturing fluid from the fluid supply 18 to enter the fracturing tree 16 through the goat head 26 and then flow into the frac stack 32. When included, the wing valves 28 and 30 can take any of various forms. In one embodiment, for example, the wing valves 28 include pumpdown valves for controlling flow of a pumpdown fluid into the frac stack 32 and the wing valves 30 include valves for controlling flowback fluid exiting the well 12 through the wellhead 14 and the frac stack 32. In some other embodiments, either the wing valves 28 or the wing valves 30 could be omitted and the remaining wing valves (or even a single remaining wing valve) 28 or 30 could be used at different times for controlling flow of both pumpdown fluid and flowback fluid.

Figure 4:
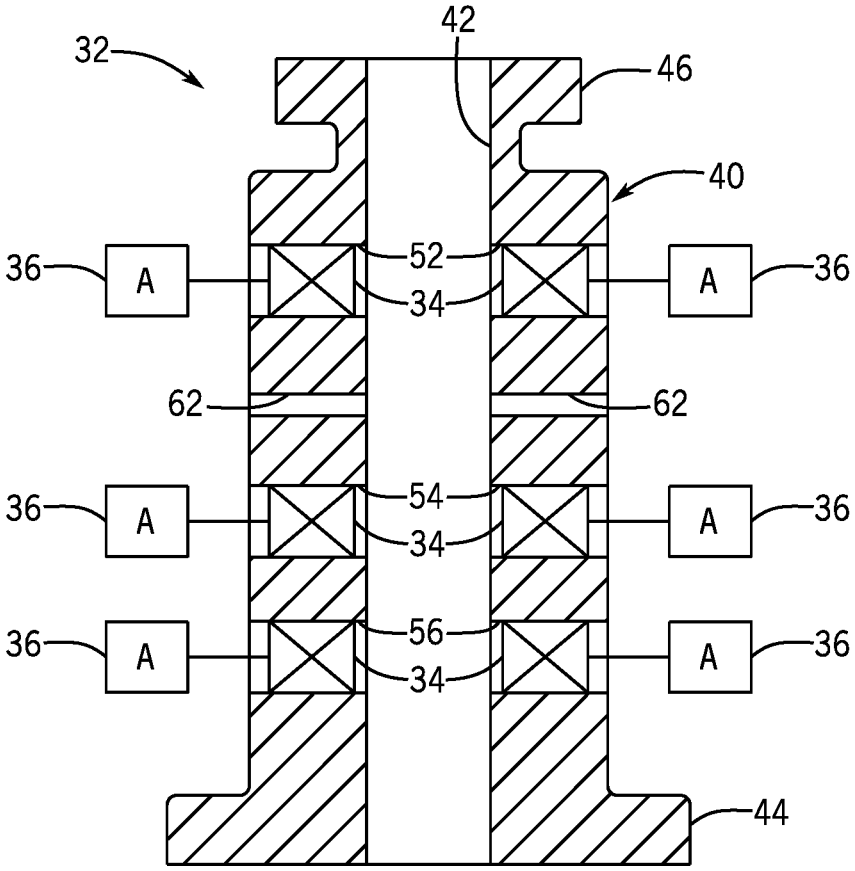
FIG. 4 is a schematic depicting the frac stack of FIG. 3 as having rams disposed in a body of the frac stack in accordance with one embodiment.

The frac stack 32 includes rams 34 that can be used to control flow of the fracturing fluid through the fracturing tree 16 (e.g., into a wellhead 14 and well 12). The frac stack 32 also includes actuators 36 for controlling opening and closing of the rams 34. One example of a frac stack 32 is depicted in FIG. 4 as having a hollow main body 40 with a bore 42 for conveying fluid through the body 40. The frac stack main body 40 also includes flanges 44 and 46 to facilitate connection of the body 40 to other components. For example, the main body 40 can be mounted on a wellhead 14 with the lower flange 44 and connected to the goat head 26 with the upper flange 46. The main body 40 can be fastened directly to the wellhead 14 and the goat head 26 in some embodiments, though in others the body 40 can be coupled to the wellhead 14 or the goat head 26 via an intermediate component, such as an adapter spool or a blowout preventer that is installed between the fracturing tree 16 and the wellhead 14.

In at least some embodiments, flow of fracturing fluid through the fracturing tree 16 and into the well 12 is controlled with rams 34 of the fracturing tree 16, and the fracturing tree 16 does not include a valve for controlling flow of fracturing fluid pumped through the fracturing tree 16 into the well 12. Further, in at least one such embodiment, the fracturing system 10 also does not include a valve between the fracturing tree 16 and the well 12 for controlling flow of fracturing fluid pumped into the well 12 through the fracturing tree 16.

The frac stack body 40 is depicted in FIG. 4 as having three pairs of opposing ram cavities—namely, ram cavities 52, 54, and 56—with installed rams 34 that are controlled by actuators 36. In other instances, however, the frac stack body 40 can have a different number of ram cavities. Rams are installed in the frac stack body 40 with keyed engagement in some embodiments to maintain desired orientation of the rams. For example, the rams may include keys that fit within slots along the ram cavities, or the ram cavities may include keys that fit within slots in the rams.

The frac stack main body 40 is also shown in FIG. 4 as including conduits 62 for routing fluid between the bore 42 and other components external to the body, such as the wing valves 28 and 30, which can be coupled to the body 40 in-line with the conduits 62. The body 40 can include valve flats or any other suitable features to facilitate attachment of the wing valves to the body. In some embodiments, a pumpdown fluid can be pumped into the bore 42 and then into a well 12 through one of the conduits 62 and flowback fluid from the well 12 can flow into the bore 42 and out of the frac stack body 40 through the other conduit 62. In another embodiment, pumpdown fluid can be pumped into the bore 42 and the flowback fluid can flow out of the bore 42 at different times through the same conduit 62. Flow through that conduit 62 may be controlled with one or more valves, such as a wing valve 28 or 30. In such cases, the body 40 may include just a single conduit 62, but other embodiments can include a different number of conduits 62. Further, conduits 62 can be provided at different axial positions along the body 40 in some instances. For example, one conduit 62 can be provided through the body 40 between ram cavities 52 and 54 (as depicted in FIG. 4), while another conduit 62 could be provided through the body 40 between the ram cavities 54 and 56. This would allow the rams in ram cavities 54 to selectively isolate the conduits 62 from one another to provide further control of flow through the body 40.

Figure 5:
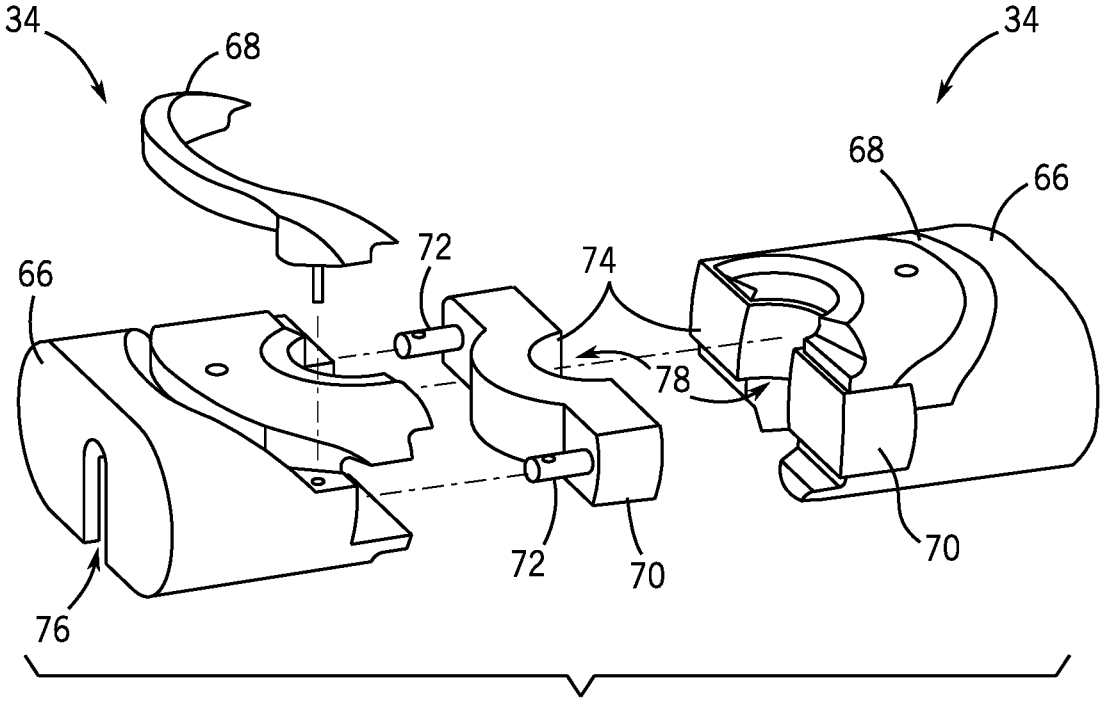
FIGS. 5 and 6 depict examples of rams that can be used in a fracturing tree, such as within the frac stack body of FIG. 4, in accordance with some embodiments.
Figure 6:
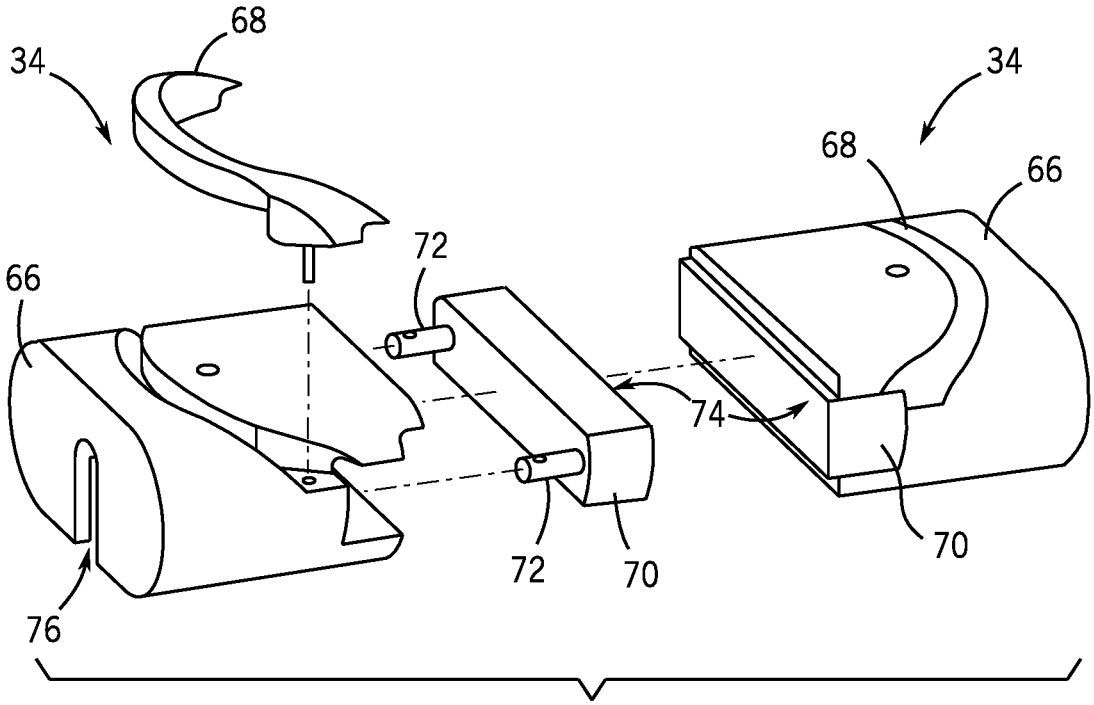

The frac stack 32 can include any suitable rams 34 and actuators 36. For example, the rams 34 can include blind rams, pipe rams, gate-style rams, or shear rams, and the actuators 36 could be electric, hydraulic, or electro-hydraulic actuators. Two examples of rams 34 that can be used in the frac stack body 40 are depicted in FIGS. 5 and 6. More particularly, the rams 34 are depicted as pipe rams in FIG. 5, with each ram 34 including a body or ram block 66, a ram seal 68 (here shown as a top seal), and a ram packer 70. The ram seal 68 and the ram packer 70 include elastomeric materials that facilitate sealing by the ram 34 in the frac stack main body 40. The ram packer 70 includes alignment pins 72 that are received in corresponding slots of the ram block 66 when the ram packer 70 is installed. The ram packers 70 include sealing surfaces 74 and recesses 78 that allow a pair of opposing pipe rams 34 to close about and seal against a tubular member, such as a pipe. The recesses 78 may be sized according to the diameter of the pipe about which the packers 70 are intended to seal. Additionally, in other embodiments, the rams 34 could be provided as variable-bore pipe rams used to seal around pipes within a range of diameters. Each ram 34 is also shown as including a slot 76 for receiving a portion (e.g., a button) of a connecting rod controlled by an actuator 36 for moving the ram 34 into and out of the bore 42 of the frac stack body 40.

Rams 34 in the frac stack body 40 may also or instead be provided as blind rams, such as those depicted in FIG. 6. In this example, the blind rams 34 include ram blocks 66, top seals 68, and ram packers 70. Unlike the packers 70 of the pipe rams in FIG. 5, however, the packers 70 in FIG. 6 do not include recesses 78 for receiving a pipe. Consequently, when installed in a frac stack body 40, the pair of blind rams 34 may close against one another along sealing surfaces 74 to seal the bore 42 and prevent flow through the frac stack 32. The ram packers 70 of FIG. 6 include alignment pins 72 similar or identical to those of FIG. 5. And like the pipe rams of FIG. 5, the blind rams shown in FIG. 6 include slots 76 for receiving connecting rods to enable control of the rams by actuators 36. Although the rams 34 depicted in FIGS. 5 and 6 are oval rams, in other instances the rams 34 could be round rams having a circular cross-section. Further, opposing rams 34 in the body 40 could instead be provided in other forms, such as gate-style rams that slide over one another or shear rams.

The actuators 36 can be hydraulic actuators with operating cylinders that are coupled to the frac stack body 40 and include operating pistons that control the position of the rams via connecting rods. In some other embodiments, the actuators 36 are electric actuators, which may include electric motors that control a drive stem for moving the rams. The actuators 36 can be attached to the frac stack body 40 in any suitable manner, such as with bonnets fastened to the frac stack body 40 with bolts, hydraulic tensioners, or clamps.

Figure 7:
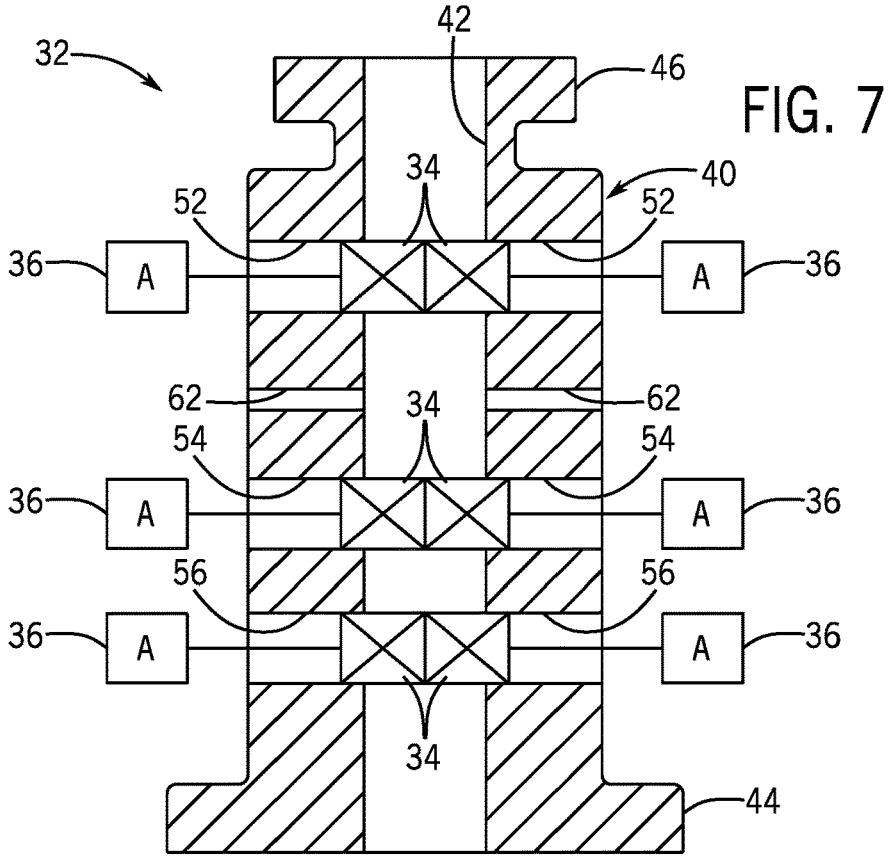
FIGS. 7 and 8 schematically depict closing of rams within the frac stack body of FIG. 4 in accordance with some embodiments.

As noted above, the rams 34 can be used to control flow through the frac stack body 40. As generally shown in FIG. 7, for example, each of the ram cavity pairs 52, 54, and 56 includes a pair of opposing rams 34 (e.g., blind rams) that are closed to seal against one another and prevent flow through the bore 42. The rams 34 in the cavities 52, 54, and 56 may be selectively retracted (i.e., opened) to allow fluid to flow through the bore 42. For instance, all of the rams 34 in FIG. 7 can be retracted to allow fracturing fluid to flow through the bore 42 from the upper end of the frac stack body 40 (such as from the goat head 26) to the lower end of the body 40, from which the fracturing fluid may flow into the wellhead 14 and then down into the well 12.

Figure 8:
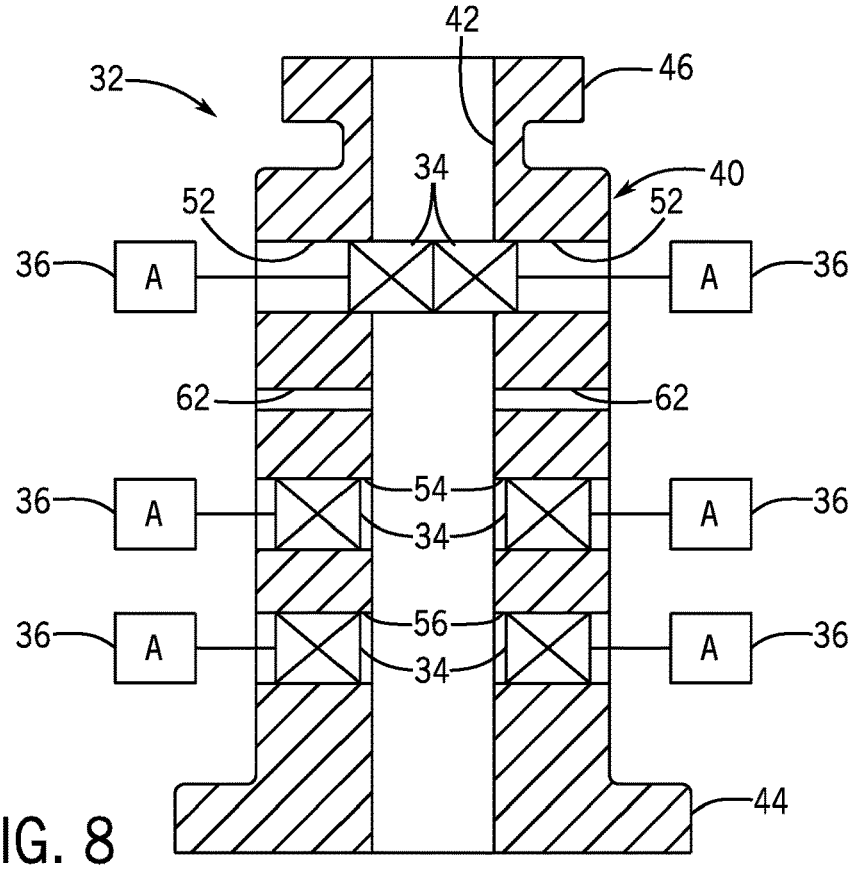

In other cases, some of the rams 34 in the frac stack body 40 are opened while other rams 34 in the body 40 remain closed. For example, the rams 34 in the ram cavities 52 may be closed while the rams 34 in the ram cavities 54 and 56 are open, as generally illustrated in FIG. 8. This allows fluid to pass between the conduits 62 and a lower portion of the bore 42, while the rams 34 of the ram cavities 52 isolate the lower portion of the bore 42 from an upper portion of the bore. In this arrangement, pumpdown fluid may be pumped through a conduit 62 into the bore 42 and then down into a well 12 while preventing flow of the pumpdown fluid out of the upper end of the frac stack 32. Similarly, flowback fluid coming up through the well 12 can be routed out of the frac stack body 40 through a conduit 62, with the closed rams 34 of the ram cavities 52 preventing flowback fluid from flowing out of the upper end of the frac stack 32.

Figure 9:
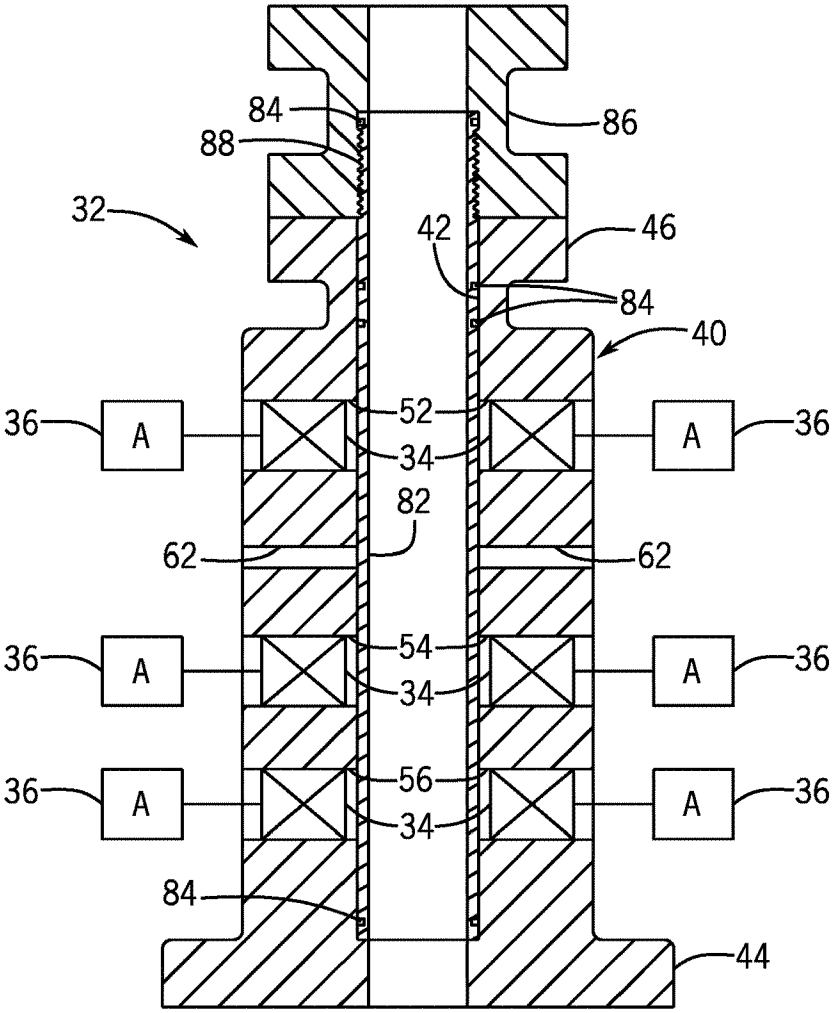

Fracturing fluid typically contains sand or other abrasive particulates that can erode components exposed to the fluid. In some embodiments, a protective sleeve is provided within the frac stack body 40 to isolate the rams 34 and their seals from erosive flow. One example of this is depicted in FIG. 9, which shows a protective sleeve 82 positioned in the bore 42 of the frac stack body 40. As shown, the protective sleeve 82 is landed on an internal shoulder within the frac stack body 40 and has an inner diameter equal to that of the bore 42 below the protective sleeve 82 at the internal shoulder. Seals 84 act as pressure barriers between the protective sleeve 82 and the wall of the bore 42 to prevent fracturing fluid from flowing along the outside of the sleeve 82 to the rams 34.

Figure 10:
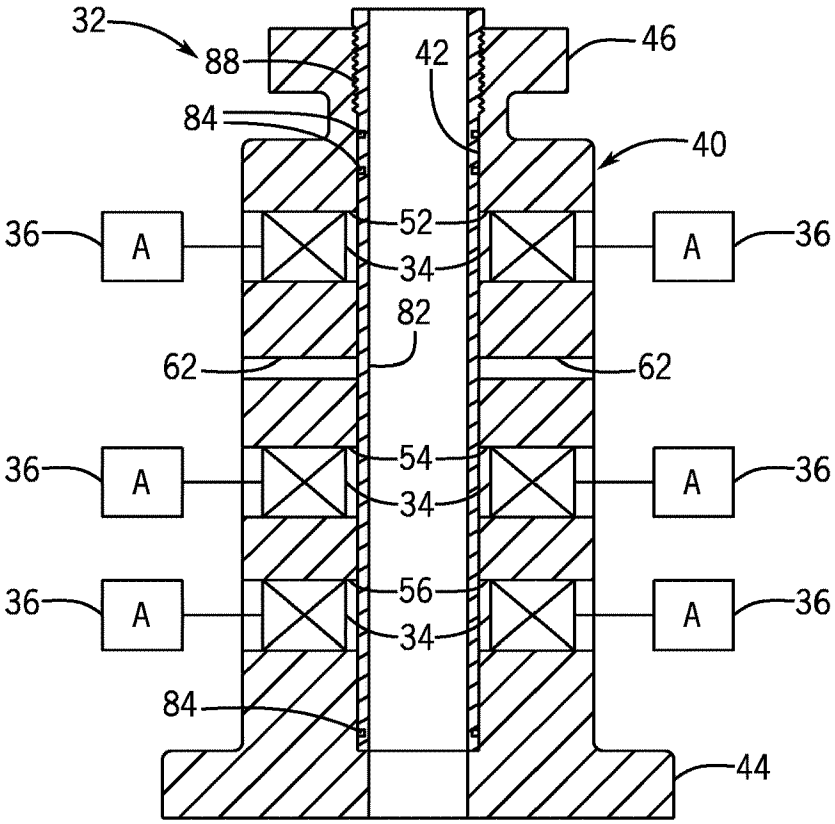
FIGS. 9 and 10 generally depict protective sleeves disposed in frac stack bodies to shield rams from erosive flow in accordance with some embodiments.

In some embodiments, the protective sleeve 82 is installed in the frac stack body 40 with an adapter component. In FIG. 9, for example, the protective sleeve 82 is connected via a threaded interface 88 to an adapter spool 86, which is fastened to the upper flange 46 of the frac stack body 40. But in other embodiments, the protective sleeve 82 is installed in the bore 42 without an adapter. One such embodiment is depicted in FIG. 10, in which the protective sleeve 82 is threaded instead to the upper end of the frac stack body 40. Although the top of the protective sleeve 82 is shown protruding from the frac stack body 40, the entire sleeve 82 could be received within the body 40 in other instances.

Figure 11:
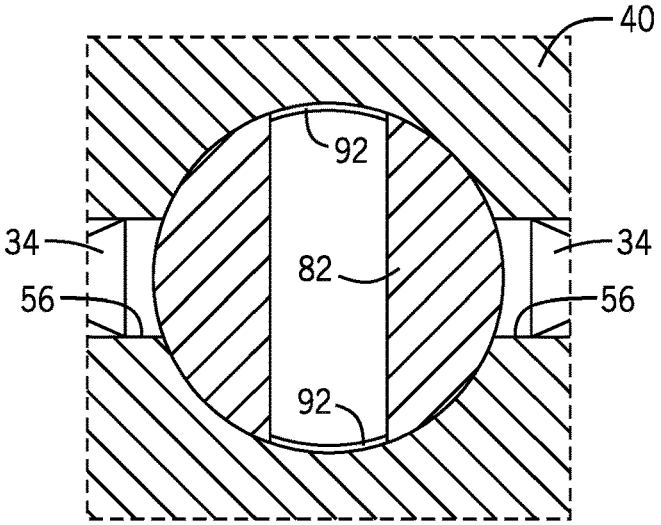
FIGS. 11-13 depict a protective sleeve that can be rotated to selectively shield rams in a frac stack body in accordance with one embodiment.
Figure 12:
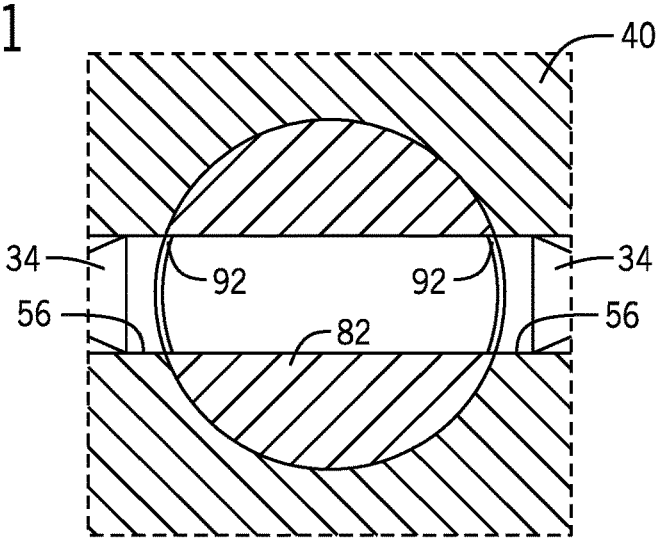
Figure 13:
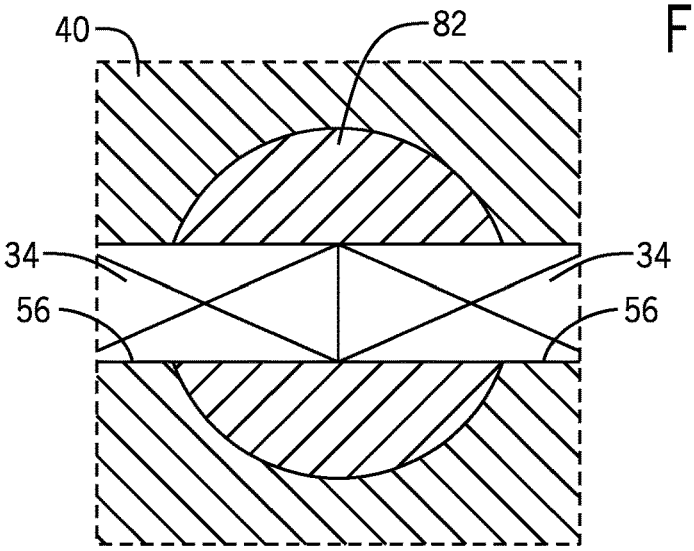

The protective sleeve 82 can be moved within the bore 42 of the frac stack body 40 to selectively cover ram cavities and protect installed rams 34. By way of example, a protective sleeve 82 with apertures 92 is depicted in FIGS. 11-13. With the sleeve 82 positioned as shown in FIG. 11, the apertures 92 are circumferentially offset from the ram cavities 56 and the side walls of the sleeve 82 shield rams 34 in the cavities 56 from erosive flow (e.g., of fracturing fluid) through the sleeve 82. Flow through the sleeve 82 (and, thus, the frac stack body 40) can be prevented by rotating the sleeve 82 to align the apertures 92 with the ram cavities 56 and then closing the rams 34 together through the apertures 92 to seal the bore, as generally shown in FIGS. 12 and 13. The rams 34 can later be opened and withdrawn out of the apertures 92 to allow flow, and the sleeve 82 can be rotated to again cover the ram cavities 56. In other embodiments, the protective sleeve 82 can be raised or lowered within the bore 42 to move the apertures 92 axially to selectively cover the ram cavities 56. Although ram cavities 56 are depicted in FIGS. 11-13, it will be appreciated that these same techniques and others described below could also or instead be used with other ram cavities, such as ram cavities 52 or 54.

Figure 16:
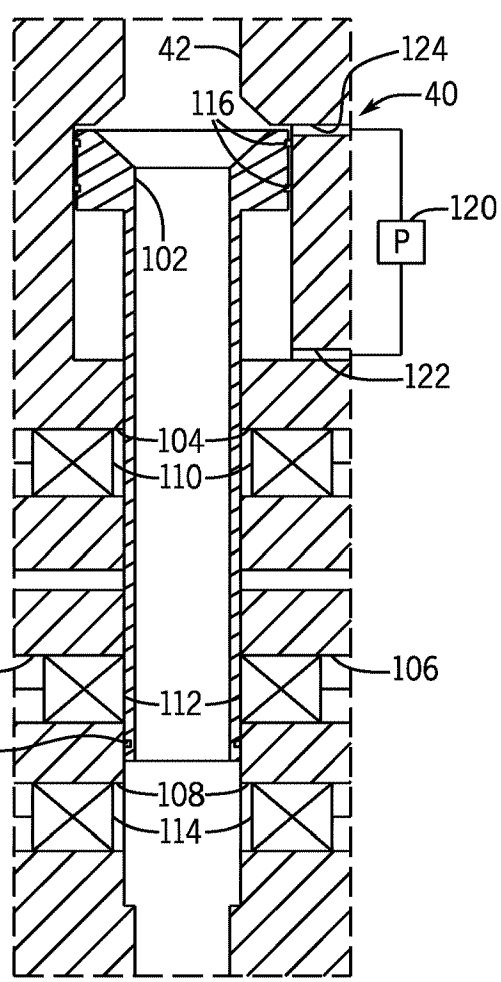
FIGS. 14-16 depict a protective sleeve that can be moved axially within a bore of a frac stack body to selectively uncover a pair of rams to facilitate flow control within the frac stack body in accordance with one embodiment.
Figure 15:
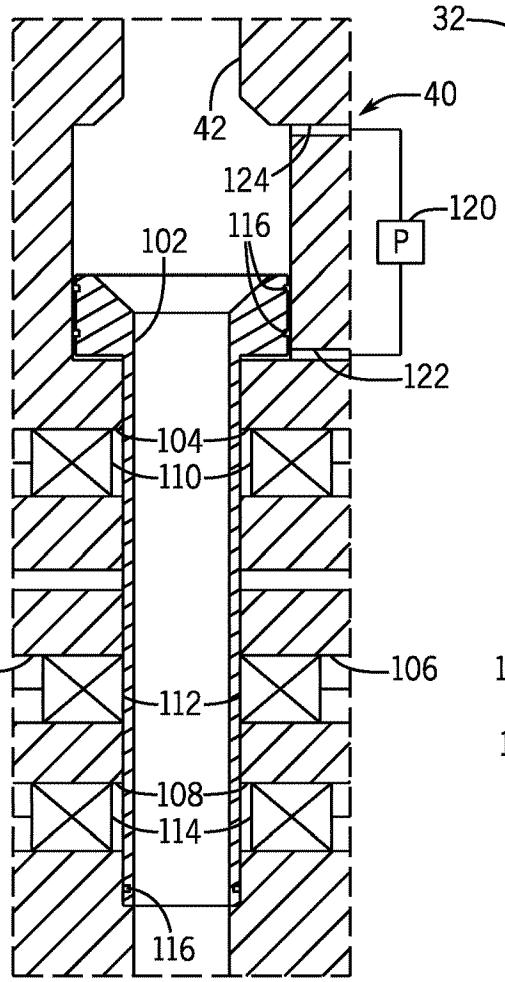
Figure 14:
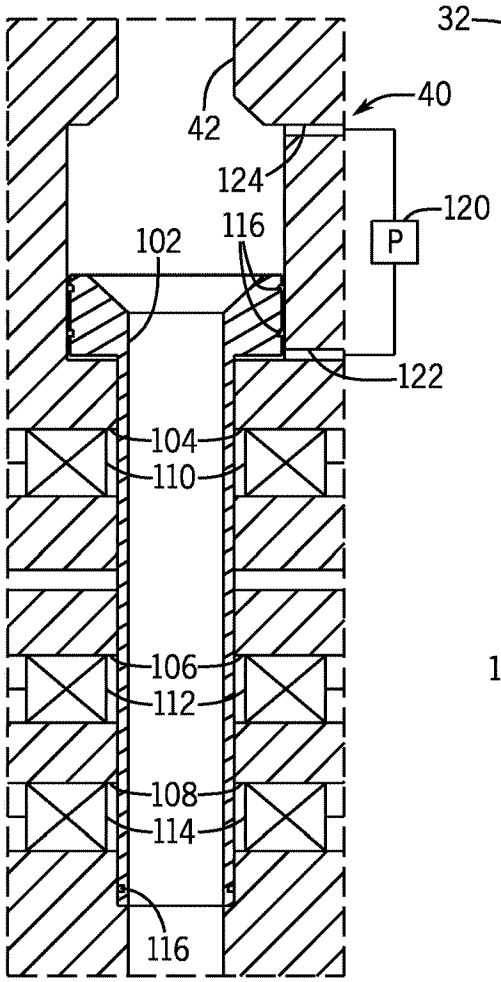

Another example of a frac stack 32 having a protective sleeve is generally depicted in FIGS. 14-16. In this embodiment, the protective sleeve 102 is disposed within the bore 42 to cover ram cavities 104, 106, and 108 and shield installed rams 110, 112, and 114 from erosive flow. The assembly includes seals 116 between the exterior of the sleeve 102 and the frac stack body 40. The seals 116 include lip seals in some embodiments, but the seals 116 (and the seals 84 above) can be provided in any suitable form. Because of the seals and the shape of the protective sleeve 102, pressurized fluid within the bore 42 applies a differential pressure on the sleeve 102 and biases the sleeve down into the position depicted in FIG. 14.

The protective sleeve 102 is shown in FIG. 14 as covering each of the ram cavities 104, 106, and 108. Although other rams may instead be used in the ram cavities, in at least some embodiments the rams 110 are shear rams, the rams 112 are pipe rams, and the rams 114 are blind rams. The protective sleeve 102 can be axially displaced to uncover the ram cavities 108 and allow the rams 114 to close and seal the bore 42.

In at least some embodiments, the protective sleeve 102 is hydraulically actuated. For example, as shown in FIGS. 14-16, the upper end of the protective sleeve 102 operates as a piston head to facilitate hydraulic actuation of the sleeve 102. More particularly, the sleeve 102 can be raised by routing fluid (such as with a pump 120) through conduit 122 into the bore 42 to lift the sleeve 102. In at least one embodiment, fluid within the bore 42 is used as the control fluid for actuating the protective sleeve 102. Fracturing fluid within the bore 42 can be diverted out from the bore 42 through conduit 124 and then be pumped with pump 120 or otherwise routed back into the bore through the conduit 122 to raise the protective sleeve 102, for instance. In at least some cases, the pipe rams 112 are closed to seal about the exterior of the sleeve 102 (as shown in FIG. 15) and fluid is then routed through the conduit 122 into the bore 42—more specifically, into an enclosed volume that is outside the sleeve 102 and partially bound by the pipe rams 112—to lift the sleeve 102 and expose ram cavities 108 (as shown in FIG. 16). The protective sleeve 102 can be lifted in different ways in other embodiments, such as with an electric motor or with an external hydraulic sleeve or cylinder. Once the sleeve 102 is lifted, the blind rams 114 may be closed to seal the bore 42 and prevent flow through the bore 42 of frac stack body 40. In an emergency, such as in the case of excessive flowback, shear rams 110 can be closed to shear the protective sleeve 102 and close the bore 42.

Figure 17:
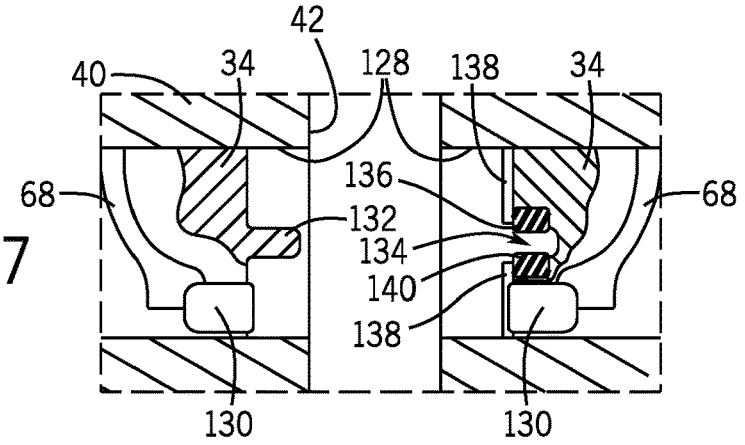
FIGS. 17-26 depict sealing configurations of rams that can be used in a fracturing tree in accordance with certain embodiments.
Figure 18:
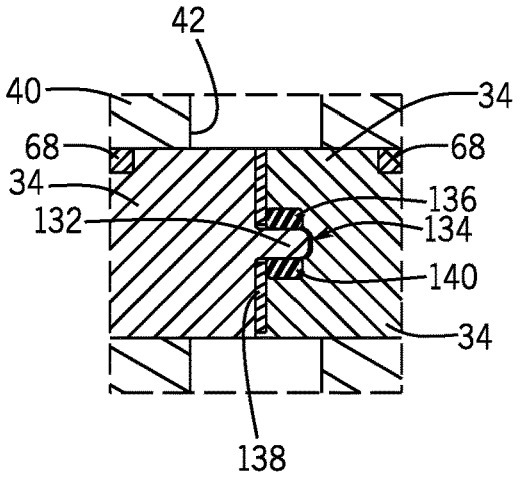

The rams of the frac stack 32 can be designed with features to reduce erosive wear on sealing elements and increase service life. One example is generally depicted in FIGS. 17 and 18, which show rams 34 disposed in opposing ram cavities 128 of a frac stack body 40. These rams 34 include top seals 68 and side packers 130 that seal against the frac stack body 40. But rather than having packers that extend across opposing front faces of the rams and seal against one another along those front faces when the rams are closed, the depicted rams 34 include a protruding ridge or nose 132 that is received in a slot 134 when the rams 34 are closed (FIG. 18).

Seals 136 and 140 (which may also be referred to as nose packers) within the slot 134 seal against the nose 132. When the rams 34 are closed, the seals 136 and 140 cooperate with the top seals 68 and the side packers 130 to prevent flow through the bore 42. Because the surfaces of the seals 136 and 140 that contact the nose 132 are positioned within the slot 134 transverse to the flow direction through the bore 42, erosive wear on these surfaces may be lower than in the case of front-facing packers (e.g., packers 70) exposed to abrasive flow generally parallel to their sealing faces. Although upper and lower nose packers 136 and 140 are depicted in FIGS. 17 and 18, either of these could be omitted and a single nose packer could be used in other embodiments. In at least some instances, plates 138 can be positioned along the front face of the ram 34 that has the nose packers 136 and 140 to retain or protect the packers 136 and 140. The plates 138 can be fastened to the ram block or attached in any other suitable manner.

Figure 19:
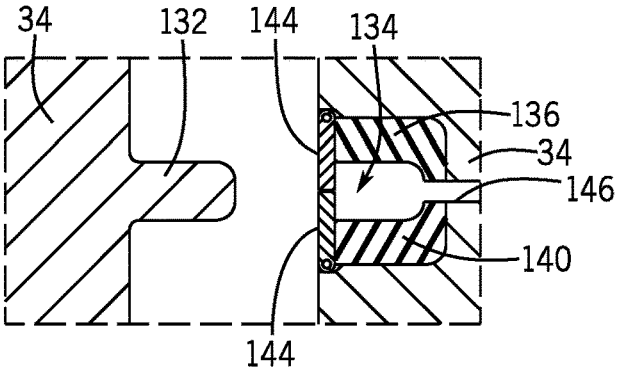
Figure 20:
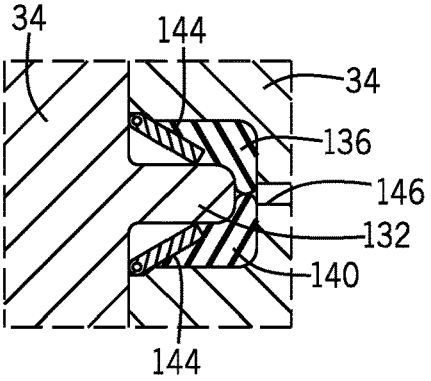

In another embodiment generally depicted in FIGS. 19 and 20, protective doors or blades 144 protect the nose packers 136 and 140. These blades 144 are displaced by the nose 132 during closing of the rams 34 against one another, with the nose packers 136 and 140 sealing against the nose 132 within the slot 134, as described above. As also shown in FIGS. 19 and 20, the ram 34 having the slot 134 can also include a weep hole 146 to allow fluid within the slot 134 to drain from the slot when displaced by the nose 132 during closing of the rams.

Figure 21:
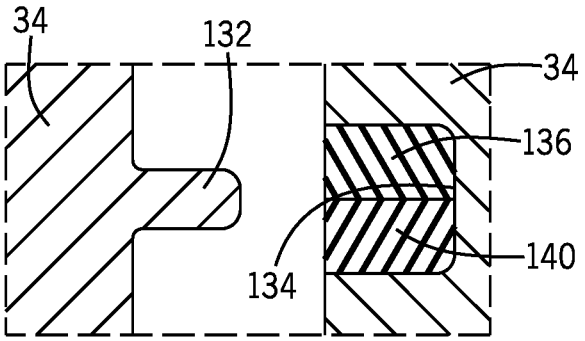
Figure 22:
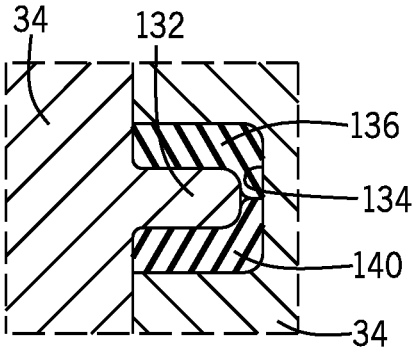

In FIGS. 17-20 above, the nose packers 136 and 140 are shown recessed from the front face of the ram. That is, the nose packers 136 and 140 in those figures are not provided at the leading edges of the rams 34. In other embodiments, the plates 138 and blades 144 are omitted and the nose packers 136 and 140 are positioned along the front face of the ram, such as depicted in FIGS. 21 and 22. In this example, the nose packers 136 and 140 press against one another when the rams 34 are open (FIG. 21), which may reduce abrasive wear on the surfaces of the nose packers 136 and 140 that seal against the nose 132 when the rams 34 are closed (FIG. 22).

Figure 23:
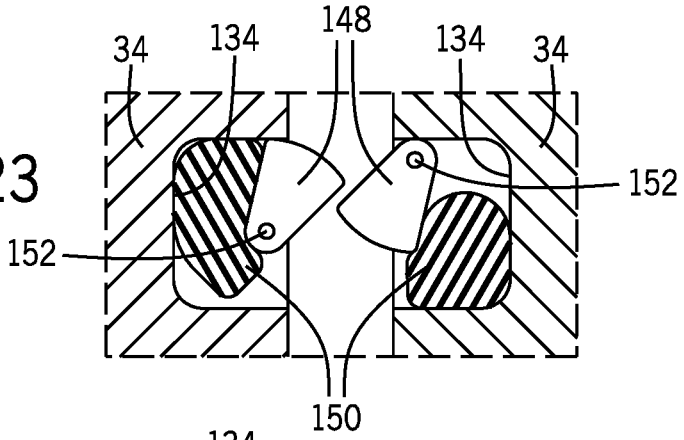
Figure 24:
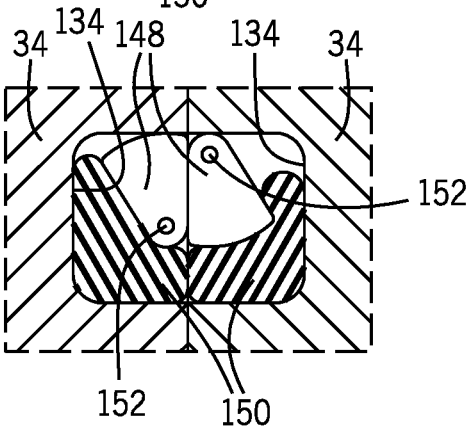

In yet another embodiment shown generally in FIGS. 23 and 24, the rams 34 include levers 148 (e.g., metal levers) that are positioned in front of seals 150 in slots 134 to protect those seals during fracturing. As depicted, the levers 148 contact each other and rotate about pins 152 when the rams close against one another. The rotating levers 148 push the seals 150 into sealing engagement with each other to close the bore and prevent flow.

Figure 25:
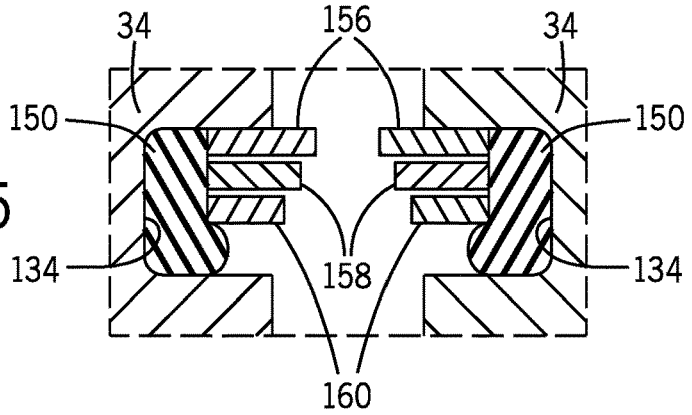
Figure 26:
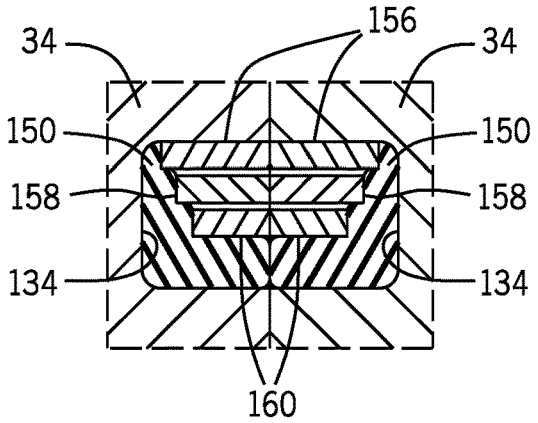

In a still further embodiment shown generally in FIGS. 25 and 26, the rams 34 include seals 150 in slots 134, along with metal plates 156, 158, and 160. These metal plates 156, 158, and 160 protect the seals 150 during fracturing and drive the seals 150 toward each other upon closing the rams 34. More specifically, as the rams 34 close, the metal plates 156 of the two rams engage one another and are pushed back into their respective slots 134 as the rams continue to close. This is followed by the metal plates 158 engaging one another and being pushed back into their slots 134, and then the metal plates 160 engaging one other and being pushed back into the slots 134, as the rams close. As the plates 156, 158, and 160 move back into the slots 134, they displace the seals 150 and drive the seals into sealing engagement with one another. While the plates 156, 158, and 160 are positioned in FIGS. 25 and 26 to generally drive the seals 150 below the plates, this could be reversed and the plates could drive the seals 150 above the plates (e.g., by flipping the rams 34). The metal plates 156, 158, and 160 can be connected within the ram 34 in any suitable manner. For example, the plates can be received in slots in the ram blocks or adhered to the seals 150. In certain embodiments, the plates 156, 158, and 160 are connected together, such as with mating pins and slots that allow the plates to slide relative to one another.

Figure 27:
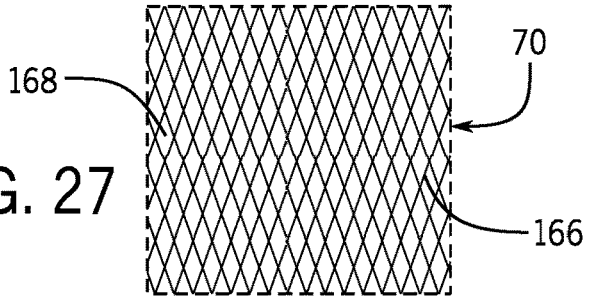
FIG. 27 depicts a portion of a ram packer or other seal having a wire mesh for reducing erosive wear of a body of the ram packer or other seal in accordance with one embodiment.

The packers and other seals described above can be formed of any suitable materials, and in at least some embodiments include elastomer. Some ram packers or seals can include a wire mesh to reduce erosive wear. For example, as depicted in FIG. 27, a ram packer 70 (or some other ram seal) includes a wire mesh 166 on an elastomer body 168. In some embodiments, the wire mesh 166 is partially embedded in the elastomer body 168, such as in a sealing face of the packer 70. The wire mesh 166 may reduce wear of the elastomer body 168 when placed in erosive service, such as within the frac stack body 40.

Figure 28:
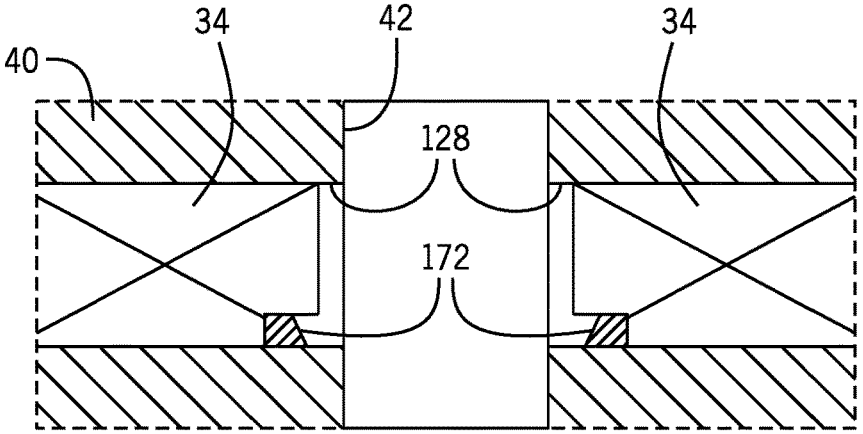
FIG. 28 depicts rams with wipers for pushing sand out of ram cavities and into a bore of a frac stack body in accordance with one embodiment.

Still further, in at least some embodiments the frac stack 32 includes features to reduce collection of sand or other particulates from the fracturing fluid within the frac stack body 40. By way of example, rams 34 in the frac stack body 40 can include blades or rubber wiper seals 172, as generally depicted in FIG. 28. As the rams 34 close, the blades or wiper seals 172 displace sand or other particulates that have settled on surfaces of the ram cavities 128. And in at least some embodiments, seals (e.g., lip seals) can be provided about the exterior of the rams 34 to seal against the surfaces of the ram cavities 128 and prevent fracturing fluid from flowing past the rams 34 from the bore 42 and depositing sand (or other particulates) behind the rams 34.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A fracturing system comprising:

a wellhead;

a frac stack mounted on the wellhead, the frac stack including opposing rams positioned to allow the opposing rams to move into a bore of the frac stack and close the bore during a fracturing injection operation to control flow of fracturing fluid into a well through the bore.

2. The fracturing system of claim 1, comprising a protective sleeve movable within the bore of the frac stack to selectively cover ram cavities having the opposing rams from the bore of the frac stack through which the flow of the fracturing fluid is controlled.

3. The fracturing system of claim 2, wherein the protective sleeve includes apertures and can be rotated between a first rotational position, in which the apertures are aligned with the ram cavities so as to enable the opposing rams to extend inwardly into the bore through the apertures, and a second rotational position, in which the apertures are offset from the ram cavities.

4. The fracturing system of claim 1, wherein the opposing rams include a pair of opposing rams having first and second rams with opposing faces, the first ram having a protruding nose on its opposing face and the second ram having a slot in its opposing face to receive the protruding nose of the first ram, and the second ram includes a seal positioned along the slot to seal against the protruding nose of the first ram when the protruding nose of the first ram is received within the slot.

5. The fracturing system of claim 4, wherein the seal positioned along the slot of the second ram is recessed from the opposing face of the second ram.

6. The fracturing system of claim 5, wherein the second ram includes a protective door provided between the bore of the frac stack and the seal positioned along the slot of the second ram.

7. The fracturing system of claim 1, wherein the opposing rams of the frac stack include a pair of opposing blind sealing rams or a pair of opposing pipe sealing rams.

8. The fracturing system of claim 7, wherein the opposing rams of the frac stack include a pair of opposing shear rams.

9. A fracturing system comprising:

a fracturing tree including a bore to route fracturing fluid from a fracturing fluid source through the fracturing tree and into a well, the fracturing tree also including a frac stack having sealing rams disposed in ram cavities within a frac stack body that includes at least a portion of the bore of the fracturing tree, wherein the ram cavities are arranged in the frac stack body to permit the sealing rams to move into the bore and close the bore during a fracturing injection operation to selectively control flow into the well through the fracturing tree.

10. The fracturing system of claim 9, wherein the fracturing tree includes a goat head coupled to the frac stack body to receive the fracturing fluid from the fracturing fluid source and to convey the fracturing fluid to the frac stack body.

11. The fracturing system of claim 9, wherein the frac stack body is coupled to a wellhead.

12. The fracturing system of claim 11, wherein the fracturing tree does not include a valve that controls flow of fracturing fluid through the fracturing tree into the well, nor does the fracturing system include such a valve installed between the fracturing tree and the well.

13. The fracturing system of claim 9, comprising wing valves coupled to the frac stack body.

14. A fracturing tree comprising:

a frac stack body having a bore for conveying fracturing fluid to a well;

rams positioned in ram cavities along the bore within the frac stack body to allow the rams to move into the bore and close the bore during a fracturing injection operation to control flow of the fracturing fluid into the well;

a passageway extending through the frac stack body from the bore to an exterior of the frac stack body; and a wing valve attached to the exterior of the frac stack body, wherein the wing valve is in fluid communication with the bore of the frac stack body via the passageway.

15. The fracturing tree of claim 14, wherein the rams positioned in ram cavities along the bore within the frac stack body include a first pair of opposing rams at a first axial location along the bore and a second pair of opposing rams at a second axial location along the bore.

16. The fracturing tree of claim 15, wherein the passageway extending through the frac stack body joins the bore between the first and second axial locations.

17. The fracturing tree of claim 16, comprising an additional passageway extending through the frac stack body from the bore to the exterior of the frac stack body.

18. The fracturing tree of claim 17, wherein the additional passageway extending through the frac stack body also joins the bore between the first and second axial locations.

19. The fracturing tree of claim 14, wherein the frac stack body includes a one-piece main body having the ram cavities in which the rams are positioned.

20. A method of controlling fluid flow through a fracturing tree of a fracturing system, the method comprising:

receiving fracturing fluid in the fracturing tree from a fracturing fluid source, the fracturing tree including a bore to route the fracturing fluid from the fracturing fluid source through the fracturing tree and into a well, the fracturing tree also including a frac stack having sealing rams disposed in ram cavities within a frac stack body that includes at least a portion of the bore of the fracturing tree, wherein the ram cavities are arranged in the frac stack body to permit the sealing rams to move into the bore and close the bore during a fracturing injection operation to selectively control flow into the well through the fracturing tree; and controlling flow of the fracturing fluid through the fracturing tree and into the well with the sealing rams installed in the body of the fracturing tree.

21. The method of claim 20, wherein the sealing rams installed in the body of the fracturing tree include a pair of opposing sealing rams, and controlling flow of the fracturing fluid through the fracturing tree and into the well includes closing the pair of opposing sealing rams against each other to prevent flow of the fracturing fluid through the fracturing tree and into the well.

22. The method of claim 20, comprising protecting a seal of at least one sealing ram of the sealing rams installed in the body of the fracturing tree from erosive wear by the fracturing fluid with a protective sleeve.

23. The method of claim 22, comprising moving the protective sleeve from a first position that prevents movement of the at least one sealing ram into the bore of the body of the fracturing tree through which fracturing fluid flows to a second position that allows movement of the at least one sealing ram into the bore.

24. The method of claim 23, wherein moving the protective sleeve from the first position to the second position includes hydraulically controlling movement of the protective sleeve from the first position to the second position with fracturing fluid received from the bore of the body of the fracturing tree.

25. The method of claim 23, wherein the sealing rams installed in the body of the fracturing tree include a pair of opposing blind rams and a pair of opposing pipe rams, and moving the protective sleeve from the first position to the second position includes closing the pair of opposing pipe rams to seal about an exterior surface of the protective sleeve and then pumping fluid into an enclosed volume that is outside the protective sleeve and is partially bound by the pair of opposing pipe rams so as to cause the protective sleeve to move from the first position to the second position.

26. The method of claim 25, wherein the protective sleeve prevents movement of the pair of opposing blind rams into the bore of the body when in the first position and allows movement of the pair of opposing blind rams into the bore when in the second position; the method also including closing the pair of opposing blind rams to seal the bore of the fracturing tree after moving the protective sleeve from the first position to the second position.

* * * * *